United States Patent [19]

Anderson

[11] Patent Number: 4,796,502

[45] Date of Patent: Jan. 10, 1989

[54] SAW BLADE STRUCTURE WITH DEPTH-CONTROL MEANS

[75] Inventor: Harvey G. Anderson, Muskegon, Mich.

[73] Assignee: Pro Power Corporation, Three Rivers, Mich.

[21] Appl. No.: 89,580

[22] Filed: Aug. 26, 1987

[51] Int. Cl.[4] ..... B27B 17/02

[52] U.S. Cl. ..... 83/834; 83/833

[58] Field of Search ..... 83/830, 831, 832, 833, 83/834

[56] References Cited

U.S. PATENT DOCUMENTS

| | | | |
|---|---|---|---|
| 614,003 | 11/1898 | Johnson | 83/831 X |
| 1,387,605 | 8/1921 | Meyer | 83/830 |
| 1,634,644 | 7/1927 | Bens | 83/832 |
| 1,642,145 | 9/1927 | Ferguson | 83/834 |
| 2,771,919 | 11/1956 | Cox | 83/834 |
| 3,945,288 | 3/1976 | Olmr | 83/834 |
| 4,309,931 | 1/1982 | Alexander | 83/832 |
| 4,464,964 | 8/1984 | Alexander | 83/830 |
| 4,484,504 | 11/1984 | Atkinson | 83/833 |
| 4,562,761 | 1/1986 | Alexander | 83/830 |
| 4,567,803 | 2/1986 | Anderson | 83/833 |

FOREIGN PATENT DOCUMENTS

| | | | |
|---|---|---|---|
| 518137 | 11/1955 | Canada | 83/834 |
| 538886 | 1/1977 | U.S.S.R. | 83/833 |

*Primary Examiner*—Frank T. Yost
*Assistant Examiner*—Eugenia A. Jones
*Attorney, Agent, or Firm*—Gordon W. Hueschen

[57] ABSTRACT

A chain saw blade having a plurality of linked cutting segments having serrated or saw teeth on the cutting edge is provided with depth-control surfaces parallel to the plane of the peaks of the teeth to limit the depth of penetration of the teeth. At the leading end of the leading depth-control surface there is a canted portion which slopes to the end edge of the segment to a point essentially coincident with the plane of the valleys of the teeth.

13 Claims, 1 Drawing Sheet

20
12
18
14
10
28
34
58
32
22
26
52
62
40
42
44
48
47
30
24
36
38
50
16
56
60
3
3

60
28
56
58
22
54
48
47
46
34
64
32
30
52
62
26
50
A
B 44
40
42
14
24
16
18
46
34
60
38
36
22
28
26
50
64
62
52

14
44
24
56
16
28
22
38
32
50
26

14
44
24
56
16
28
22
38
32
64
62
52
26

SAW BLADE STRUCTURE WITH DEPTH-CONTROL MEANS

FIELD OF THE INVENTION AND PRIOR ART

This invention relates to a saw blade structure with depth-control means and is particularly directed to an articulated endless-band saw blade with a saw-toothed cutting edge which is provided with depth control means.

Chain saws are known in the art which have cutting-link segments with saw teeth cut in the cutting edge thereof, the peaks of which are alined in a cutting plane and the valleys thereof alined in a second plane parallel to said cutting plane. See for example, U.S. Pat. Nos. 4,309,931; 4,464,964; and 4,562,761. Such chain saws suffer the disadvantage that the teeth tend to bite into the material being sawn, especially if it is soft, with the result that the saw tends to buck or chatter and sometimes even stall.

THE OBJECTS OF THE INVENTION

The objects of the invention are to provide a saw blade of the class described which avoids this disadvantage and has advantages that will appear as the description proceeds.

SUMMARY OF THE INVENTION

The invention relates to a chain saw cutting-link segment having a leading end and a trailing end and saw teeth forming a cutting edge therebetween with the teeth alined in a unit cutting plane and the valleys between alined in a second plane parallel to said cutting plane and comprising depth-control means disposed adjacent to at least one end of said segment and between the cutting plane and the second plane, which depth-control means functions to limit the depth to which the teeth can penetrate into the material being cut in any one traverse.

The invention also comprises one or more further features in which said depth-control means comprises at least one planar surface disposed between and parallel to said planes, which planar surface is spaced from the cutting plane a distance sufficient for the teeth to bite into the material being cut but less than the normal maximum depth of penetration of said saw teeth in the absence of depth-control means;

in which there is a depth-control surface adjacent the leading end of said segment which comprises a canted planar surface which slopes to the end edge of the leading end of said segment and which forms a corner therewith disposed substantially in alinement with said second plane;

in which desirably there is a depth-control surface at each end of said segment; and in which said segment has a bearing edge comprising outer portions which are parallel to said cutting plane, a central portion comprising a driving-sprocket notch, and canted central portions in between which slope from the outer portions toward said cutting plane to an intersection with said notch.

More particularly the invention is directed to an improvement in an articulated, endless-band saw blade adapted endlessly to rotate on a blade support having a planar cutting portion, an arcuate portion, a delivery portion, and a drive portion, said blade comprising cutting-link segments and connecting-link segments, said cutting-link segments having saw teeth the teeth of which line up in a unit cutting plane parallel to said cutting portion and the valleys between the teeth line up in a second plane parallel to said cutting plane when the cutting-link segments are traversing said cutting portion: which improvement comprises; depth-control means disposed adjacent each end of said segment and between said unit cutting plane and said second plane which functions to limit the depth to which the teeth can penetrate into the material being cut; and, if desired, one or more further features as described above.

The invention also relates to a chain saw with like characteristics.

DESCRIPTION OF A PREFERRED EMBODIMENT

Figure 1:
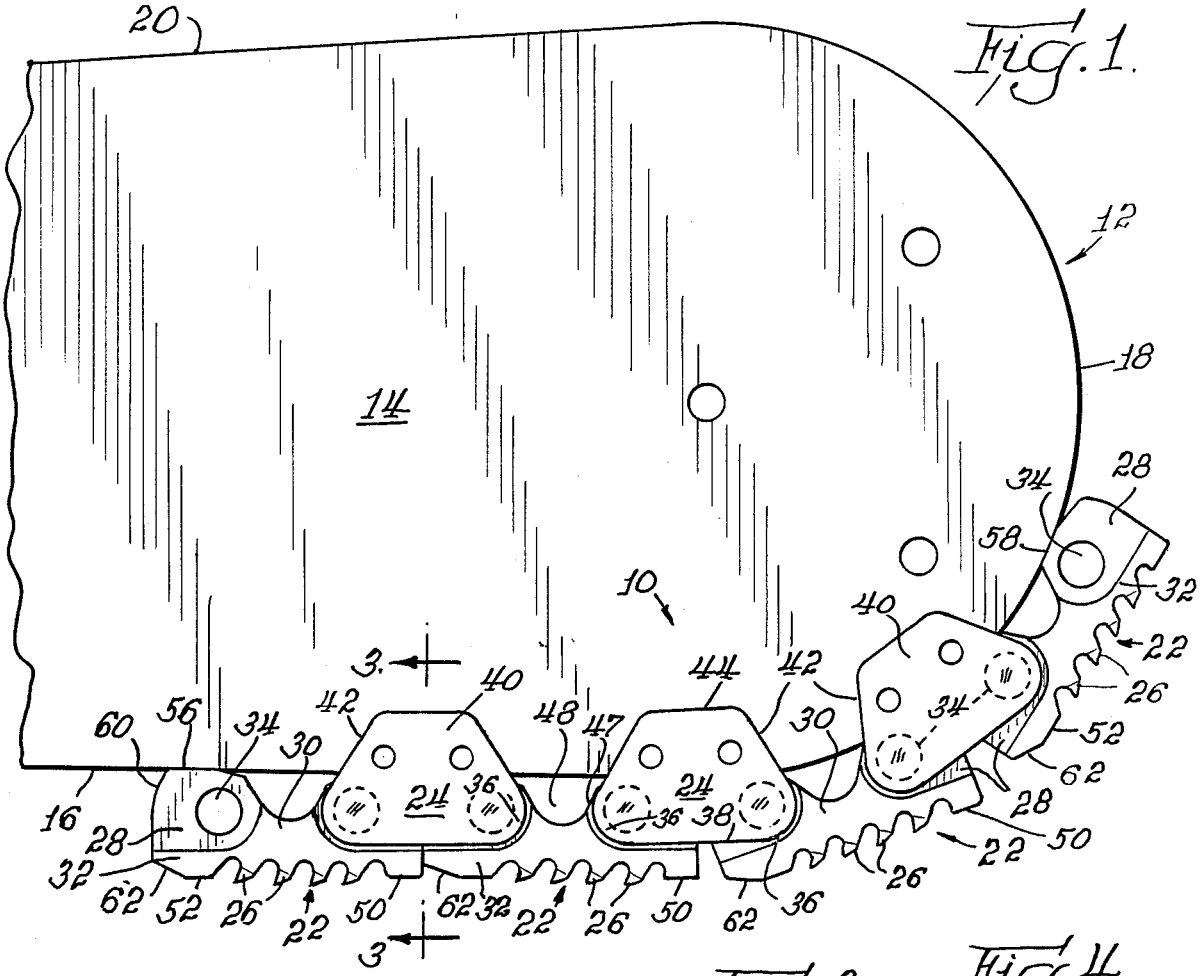
FIG. 1 is a partial view in side elevation.

In FIG. 1 there is shown an articulated, endless-band saw blade 10 mounted on a blade support 12. The blade support is made of a plate 14 of metal or like material having a planar cutting edge portion 16, a curvilinear or arcuate end portion 18, a delivery portion 20 which receives the articulated blade from a drive portion (not shown) and delivers it to the cutting portion via the arcuate end portion.

The invention is applicable to any chain saw with a serrated or saw-toothed cutting edge, for example, as in the U.S. Patents cited above as well as in U.S. Patent application Ser. No. 934,397 filed Nov. 24, 1986 and owned by the assignee of the present application. Those patents and that application are relied upon for details not shown herein and for that purpose are incorporated herein by reference. The invention is not limited to this particular construction, however, and is applicable to any chain saw with a serrated or saw-toothed cutting edge, for example, as in the U.S. Patents cited above.

In general, these types of chain saws have cutting-link segments 22 linked into an endless chain by connecting-link segments 24. Each cutting-link segment has a series 26 of saw teeth which are alined in a unit cutting plane and, when two or more cutting-link segments are traversing the cutting portion of the blade support, the unit cutting planes line up in a common cutting plane.

The cutting-link segments 22 are undercut at each end to provide recessed portions or chamfers 28 shaped to conform with the ends of the connecting-link segments 24, and to leave an intact cutting portion 30 having end portions or shoulders 32 each parallel to a unit cutting plane. Adjacent one end of each chamfer 28 is a relatively large circular hole 34. A pivot disc (not shown) is disposed in each hole and the connecting-link segments are spot-welded thereto thereby pivotally connecting the cutting link segments 22 and the connecting-link segments 24 into an endless chain.

The inner ends of the chamfers are concentric with the holes 34 and the outer ends 36 of the connecting-link segments are concentric with these holes on a slightly smaller radius and are connected by a tangential planar top edge 38 adapted to abut, or substantially to abut, the shoulders 32 when the unit cutting planes are alined in the common cutting plane.

The connecting-link segments have a trapezoidal portion 40 having sides 42 which extend down equiangularly as tangents to the concentric ends 36 to a base portion 44 generally parallel with the planar top edge 38.

Each cutting-link segment has a riding edge 46 at each end adapted to ride on the blade support and separated by a driving-sprocket notch 48 adapted to be engaged by a power-driven sprocket (not shown) for the propulsion of the chain around the blade support. The sides 47 of the driving-sprocket notch line up with and are apparent extensions of the sides 42 of the connecting-link segments when the cutting-link segments are traversing the cutting portion of the blade support.

The trapezoidal portions 40 extend beyond the riding edges 46 and provide guide channels which lap each side of the blade support to keep the riding edges 46 on the blade support. The outer faces of the connecting-link segments and the cutting-link segments other than the chamfers 28 and the cutting teeth 26 form smooth planar surfaces spaced apart slightly less than the width of the kerf which is determined by the set of the teeth.

The cutting edge of the cutting-link segment comprises regular saw teeth having sharp cutting peaks alternating with valleys. These teeth can be filed like the teeth of an ordinary cross-cut saw or rip saw and are given any desired kerf-determining set with an ordinary setting tool.

At each end of a series of teeth in a cutting-link segment there are provided depth control surfaces 50 and 52 which serve to limit the depth to which the teeth can penetrate and thus to limit the amount of material that is taken from the bottom of the kerf in each incremental passage of the teeth through the material being cut.

Figure 2:
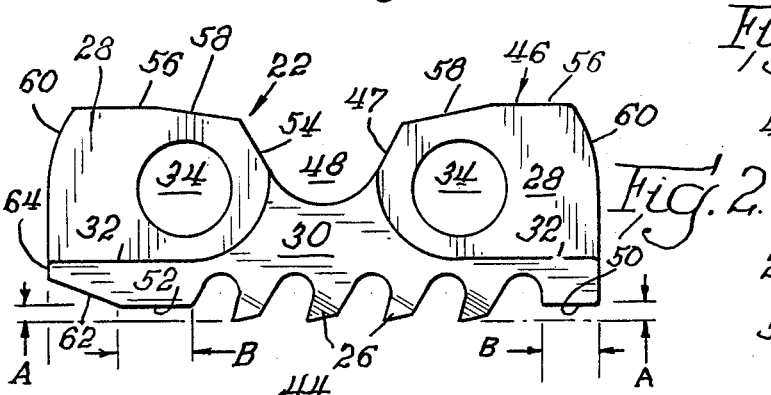
FIG. 2 is a side view of a cutting-link segment.

These depth-control surfaces are essentially planar and generally parallel to the unit cutting plane and are disposed between that plane and the unit plane coinciding with the valleys or bottoms of the teeth. FIG. 2 illuatrates this spacing at "A". This spacing, that is, the spacing of the depth-control surface from the unit cutting plane, depends upon the material being cut as well as upon the size and number of the teeth. In soft wood, teeth tend to bite in deeper and the character of the teeth (number and size) is determined accordingly. For hardwood or metal, the teeth desirably are smaller and closer together. Thus, no hard and fast rule can be given for the determination of the optimum depth other that than to say that it should be between the two planes, that is, the unit cutting plane and the unit plane coinciding with the bottoms of the valleys, and preferably a distance sufficient for the teeth to bite into the material being cut but less than the normal maximum depth of penetration of the saw teeth in the absence of depth control means.

Each riding edge 46 of the cutting link segments is multifaceted. It has an inner portion 54 which is coincident with sides of the driving-sprocket notch 48, an outer portion 56, a middle portion 58, and an end portion 60 which is curved and is generally concentric with the hole 34 so that the links can rotate freely about the pivots. The outer portion is parallel with the unit cutting plane so that, when the segments are traversing the cutting portion of the blade support, only the outer portion contacts the blade support and rides on it in face-to-face planar contact, as best seen at the left end of FIG. 1 and, when the segments are traversing the curvilinear end portion of the blade support, only the middle portion contacts the blade support and rides tangentially on it normal to a radius thereof, as shown at the right end of FIG. 1.

Figure 5:
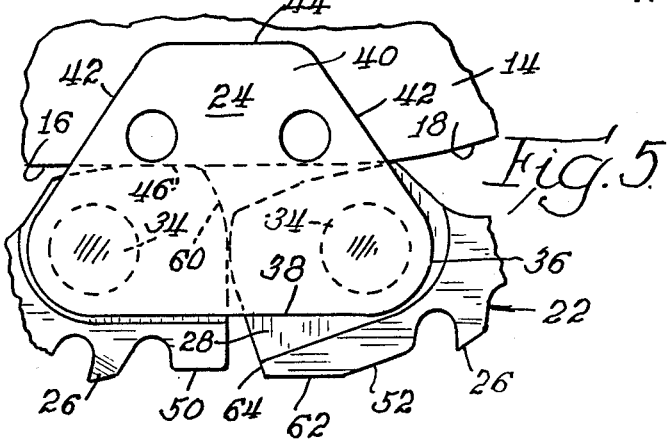
FIG. 5 is a detail view of FIG. 1.
Figure 3:
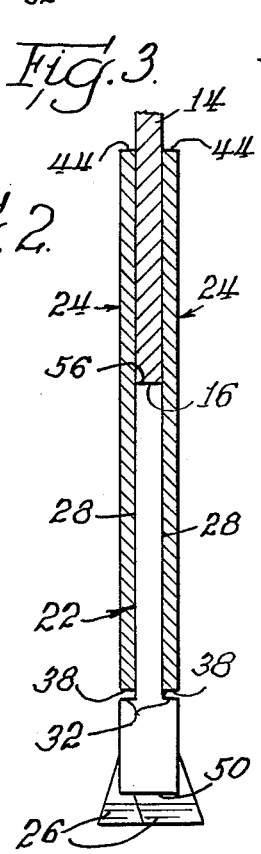
FIG. 3 is a section taken on line 3—3 of FIG. 1 looking in the direction of the arrows.
Figure 4:
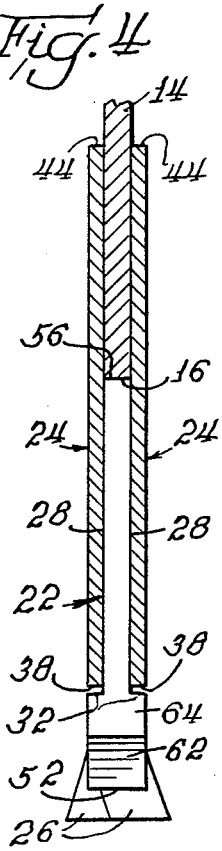
FIG. 4 is a section taken on line 3—3 of FIG. 1 looking in the other direction.

In the prefered embodiment, the depth control surface 52 at the leading end of the cutting-link segment has a canted extension or portion 62 which slopes down from the leading end of the depth-control surface 52, to the leading-end edge 64 at a point generally coincident with the unit plane coincident with the bottoms of the valleys. The precise point, however, is not critical as long as enough of the original corner of the leading end edge has been removed to prevent it from digging-in when the cutting-link segment begins to leave the curvilinear portion of the blade support as shown in FIGS. 1 and 5.

The length "B" of the depth-control surfaces 50 and 52 as shown in FIG. 2, like the spacing "A", is variable according to the type of material and the number and spacing of the teeth in the unit. In general, it need not be wider than the spacing between the teeth. Desirably it is as short as possible so as not to take up room that otherwise would be available for teeth. Consonant with this, it may be desirable with some materials to eliminate one of the depth-control surfaces, in which case it is preferred to retain the one on the leading edge with its canted portion as this eliminates a leading corner of the cutting-link segment and thus tends to avoid or minimize the "digging in" that could otherwise occur.

The invention makes it feasible effectively to make and use a chain saw with serrated teeth without encountering the grabbing and chattering that otherwise sometimes occurs with such saws and makes feasible the use of such saws with a wider variety of materials than has been heretofore possible.

It is to be understood that the invention is not to be limited to the exact details of construction, operation, or exact materials or embodiments shown and described, as various modifications and equivalents will be apparent to one skilled in the art, and the invention is therefore to be limited only by the scope of the appended claims.

I claim:

1. A chain saw cutting link segment having a leading end and a trailing end and saw teeth forming a cutting edge therebetween with the teeth alined in a unit cutting plane and valleys between the teeth alined in a second plane parallel to said cutting plane and comprising depth-control means disposed adjacent the trailing and leading ends of said segment and between the cutting plane and the second plane, which depth-control means comprises planar surfaces disposed between and parallel to said planes, in which said planar surfaces lie in a plane parallel to said cutting plane and are spaced therefrom a distance sufficient for the teeth to bite into the material being cut but less than the normal maximum depth of penetration of said saw teeth in the absence of depth-control means, depth-control surface adjacent the leading end of said segment comprises a canted non-cutting planar surface which is normal to a longitudinal plane normal to said cutting plane and slopes to the leading end edge of said segment and which forms a corner with said leading end edge which is disposed substantially in alinement with said second plane.

2. A chain saw cutting-link segment of claim 1 in which said segment has a bearing edge comprising outer portions which are parallel to said cutting plane, a driving-sprocket notch having diverging sides, and canted central portions in between which slope from said outer portions toward said cutting plane to an intersection with the diverging sides of said notch.

3. A chain saw cutting-link segment having a leading end and a trailing end and saw teeth forming a cutting edge therebetween with the teeth alined in a unit cutting plane and valleys between the teeth alined in a second plane parallel to said cutting plane and comprising depth-control means disposed adjacent to at least one end of said segment and between the cutting plane and the second plane, which depth-control means functions to limit the depth to which the teeth can penetrate into the material being cut in any one traverse, and in which said segment has a bearing edge comprising outer portions which are parallel to said cutting plane, a driving-sprocket notch having diverging sides, and canted central portions in between which slope from said outer portions toward said cutting plane to an intersection with the diverging sides of said notch.

4. A chain saw cutting-link segment of claim 3 in which said depth-control means comprises planar surfaces disposed between said saw teeth and the ends of the segment and between and parallel to said planes, which planar surfaces are spaced from the cutting plane a distance sufficient for the teeth to bite into the material being cut but less than the normal maximum depth of penetration of said saw teeth in the absence of depth-control means.

5. A chain saw cutting-link segment of claim 4 in which the depth-control surface adjacent the leading end of said segment has a canted noncutting planar surface which is normal to a longitudinal plane normal to said cutting plane and slopes from the leading end of said planar surface to the leading end edge of said segment and forms a corner therewith disposed substantially in alinement with said second plane.

6. An articulated, endless-band saw blade adapted endlessly to rotate on a blade support having a planar cutting portion, an arcuate portion, a delivery portion, and a drive portion, said blade comprising cutting-link segments articulated by non-cutting connecting-link segments, said cutting-link segments having saw teeth in the cutting edge thereof the teeth of which line up in a unit cutting plane parallel to said cutting portion when the cutting-link segments are traversing said cutting portion and valleys between the teeth which line up in a second plane parallel to said cutting plane;

depth-control means disposed adjacent each end of said cutting-link segment and between said unit cutting plane and said second plane which functions to limit the depth to which the teeth can penetrate into the material being cut in any one traverse, in which said depth-control means comprises substantially abutting trailing and leading non-cutting planar surfaces disposed between the trailing and leading ends of said saw teeth and the trailing and leading end edges, respectively, of said cutting-link segment and between and parallel to said unit cutting plane and said second plane, which planar surfaces are spaced from said unit cutting plane a distance sufficient for the teeth to bite into the material being sawn but less than the maximum depth of penetration of said saw teeth in the absence of depth-control means, in which a canted non-cutting planar surface which is normal to a longitudinal plane normal to said unit cutting plane and slopes from the leading end of said leading planar surface to the leading end edge of said cutting-link segment and forms a corner therewith disposed substantially in alinement with said second plane, and in which the end edges of said segments and the end edges of said depth-control means lie in a common plane normal to said cutting plane.

7. A saw blade of claim 6 in which each cutting-link segment has a bearing edge adapted to ride on a blade support which bearing edge has outer portions which are parallel to said cutting plane and adapted to ride in face-to-face contact with said cutting portion during its traverse thereof, a central portion comprising a driving-sprocket notch, and canted planar portions in between which slope from said outer portions toward said cutting plane to an intersection with said notch and in which each canted portion is canted at an angle such that, when said segment is traversing the arcuate portion of the support, the canted portion is normal to a radius of said arcuate portion.

8. A saw blade of claim 7 in which said notch has an arcuate head portion and equiangular side portions which slope from said arcuate head portion to said canted planar portions forming an obtuse angle therewith.

9. A saw blade of claim 8 in which said cutting-link segment has a circular pivot hole adjacent each end and in which said equiangular side portions and said canted portions are substantially equally spaced from said hole and normal to radii thereof.

10. A band saw comprising a blade support having a planar cutting portion, a delivery portion, an arcuate portion, an articulated, endless-band saw blade adapted endlessly to rotate on said blade support and comprising cutting-link segments and connecting-link segments abutting one another and having leading and trailing ends and cutting teeth with cutting points alined in a unit cutting plane over said cutting portion and valleys alined in a second plane parallel to said cutting portion when the cutting-link segments are traversing said cutting portion and depth-control means disposed adjacent each end of each cutting-link segment and between said unit cutting plane and said second plane, which depth-control means functions to limit the depth to which the teeth can penetrate into the material being cut in any one traverse; in which said depth-control means comprises trailing and leading planar surfaces disposed between the trailing and leading ends of said saw teeth and the trailing and leading ends edges, respectively, of said cutting-link segments and between and parallel to said planes, which planar surfaces are spaced from the cutting plane a distance sufficient for the teeth to bite into the material being cut but less than the normal maximum depth of penetration of the saw teeth in the absence of depth-control means; and in which a canted non-cutting planar surface, which is normal to a longitudinal plane normal to said cutting plane, slopes from the leading end of said leading planar surface to the leading end edge of said segment and forms a corner therewith disposed substantially in alinement with said second plane.

11. A band saw comprising a blade support having a planar cutting portion, a delivery portion, an arcuate portion, an articulated, endless-band saw blade adapted endlessly to rotate on said blade support and comprising cutting-link segments and connecting-link segments abutting one another and having leading and trailing ends and cutting teeth with cutting points alined in a unit cutting plane over said cutting portion and valleys alined in a second plane parallel to said cutting portion when the cutting-link segments are traversing said cutting portion and depth-control means disposed adjacent each end of each cutting-link segment and between said unit cutting plane and said second plane, which depth-control means functions to limit the depth to which the teeth can penetrate into the material being cut in any one traverse, in which each cutting-link segment has a bearing edge adapted to ride on said blade support which bearing edge has outer portions which are parallel to said cutting plane and adapted to ride in face-to-face contact with said cutting portion during its traverse thereof, a central portion comprising a driving-sprocket notch, and canted planar portions in between which slope from the outer portions toward said cutting plane to an intersection with said notch and in which each canted portion is canted at an angle such that, when a canted portion is traversing the arcuate portion of said support, it is normal to a radius of said arcuate portion.

12. A saw blade of claim 11 in which said notch has an arcuate head portion and equiangular side portions which slope from said arcuate head portion to said canted planar portions forming an obtuse angle therewith.

13. A saw blade of claim 12 in which each cutting-link segment has a circular pivot hole adjacent each end and in which each equiangular side portion and each canted portion adjacent thereto are substantially equally spaced from said hole and normal to radii thereof.

* * * * *

UNITED STATES PATENT AND TRADEMARK OFFICE

CERTIFICATE OF CORRECTION

PATENT NO. : 4,796,502

DATED : January 10, 1989

INVENTOR(S) : Harvey G. Anderson

It is certified that error appears in the above-identified patent and that said Letters Patent is hereby corrected as shown below:

Col. 3, line 41; "illuatrates" should read -- illustrates

Col. 4, line 5; "prefered" should read -- preferred --

Col. 4, line 58; after "means," insert -- and in which the --

Col. 6, line 50; "ends" should read -- end --

Signed and Sealed this

Twenty-seventh Day of June, 1989

*Attest:*

DONALD J. QUIGG

*Attesting Officer*

*Commissioner of Patents and Trademarks*